United States Patent [19]

McPherson

[11] Patent Number: 4,660,536

[45] Date of Patent: Apr. 28, 1987

[54] COMPOUND ARCHERY BOW SYSTEM

[76] Inventor: Mathew A. McPherson, 1110 24th Ave. Southwest, Austin, Minn. 55912

[21] Appl. No.: 742,404

[22] Filed: Jun. 7, 1985

[51] Int. Cl.[4] ..... F41B 5/00

[52] U.S. Cl. ..... 124/24 R; 124/DIG. 1

[58] Field of Search ..... 124/23 R, 24 R, DIG. 1

[56] References Cited

U.S. PATENT DOCUMENTS 4,061,124 12/1977 Groner ..... 124/23 R 4,078,537 3/1978 Carella ..... 124/24 R 4,440,142 4/1984 Simonds ..... 124/23 R

*Primary Examiner*—Richard C. Pinkham

*Assistant Examiner*—Benjamin Layno

[57] ABSTRACT

A compound archery bow assembly having a cam wheel rotatably mounted at each end of the bow wherein each cam wheel includes an interior cam slot with a cam mounted therein which forms the supporting connection between the end portion of the bow and the cam wheel, whereby a maximum increment of drop-off can be obtained with an extremely simple and inexpensive cam wheel design.

6 Claims, 7 Drawing Figures

COMPOUND ARCHERY BOW SYSTEM

SUMMARY OF THE INVENTION

The present invention achieves its results by the use of a pair of cam wheels or pulleys, each having an outside groove in which the bow string cable is received with the wheels being respectively supported by an internal cam mounted on the end portions of the bow and respectively riding in an internal, eccentric cam slot formed in each cam wheel, said slot having the cam-engaging portion during the hold position of the bow string at full draw, disposed in close proximity to the outer periphery of the cam wheel. The bow assembly permits maximum drop-off to be obtained to produce a minimum hold weight without reducing the ultimate power of the bow.

BACKGROUND OF THE INVENTION

In the past, a number of compound archery bows have been developed, including the type disclosed in U.S. Pat. No. 3,486,495 to Allen issued Dec. 30, 1969, and U.S. Pat. No. 4,201,177 to Holman and Ketchum issued May 6, 1980. In general, the sole purpose of producing a compound bow is to substantially reduce the hold weight without decreasing the projecting power of the bow.

DETAILED DESCRIPTION OF THE INVENTION

Figure 1:
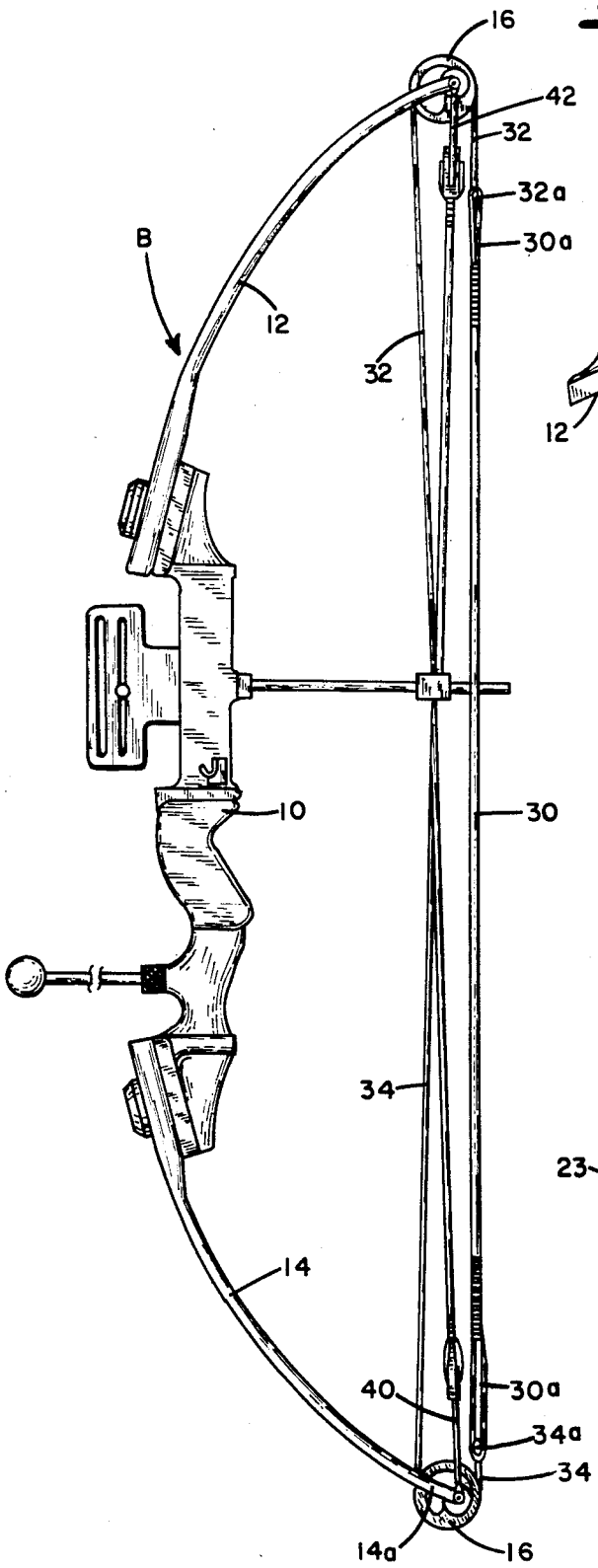
FIG. 1 is a side elevational view of a typical compound bow embodying my invention.

Two forms of the present invention are illustrated in the drawings, both of which are constructed to provide substantial degrees of drop off in the holding strength required for the bow. The drawings show a bow assembly designated by the letter B which includes a central handle portion 10 having an upper limb element 12 and a lower limb element 14 connected at their inner ends in fixed relation to the respective handle portion 10. The limb elements 12 and 14 provide the desired resistance to bending which determines the draw weight and force with which the arrow is discharged.

The outer ends of the bow of the limb elements 12 and 14 have a wheel-receiving slot defined by a pair of spaced-apart mounting arms respectively designated by the numerals 12*a* and 14*a*. Each slot provides space to receive the weight reducing wheel members 16 best shown in FIGS. 1–3. The design of the wheels 16 includes an interior cam slot 18 which in the form illustrated in FIGS. 1–3, has an eccentrically shaped "heart" design with an apex 18*a* and the variable eccentric cam track running from relaxed cam position 18*b* shown in FIG. 2, to full draw cam position at 18*c*. An interior cam 20 is positioned within the cam slot 18 to travel around the inner surface thereof between positions 18*b* and 18*c* during the drawing operation of the bow B. The cam 20 is mounted on a pin 22 which in turn is supported by the mounting arms 12*a* and 14*a* at the respective ends of the limbs 12 and 14. The cam 20 in the form shown, is a roller rotatably mounted on the pin 22 between a pair of boss elements 23 and the outer surface of the cam 20 rolls around the cam track surface of the slot 18 between the positions 18*b* and 18*c* as the bow is drawn.

A bow string 30 has a pair of loops 30*a* at the ends thereof which are removably connected to the "tear drop" anchor elements 33 and 34*a* which are respectively connected at one of the ends of the two compound action cables 32 and 34. The cable 32 passes around a portion of the upper wheel 16, across to the opposite side of the wheel and has an intermediate portion 32*a* thereof positively anchored to said wheel as by a set screw 16*a* threadably mounted on an inner portion of the wheel 16. The cable 32 passes around the wheel 16 and down to an anchoring yoke 40 which is fastened to the cross pin 22 supported by the mounting arms 14*a*. The other cable 34 passes around a portion of the lower wheel 16 with an intermediate portion thereof positively anchored to the wheel as by the set screw 16*a* in the same manner as described and shown in connection with the upper wheel 16.

The cable 34 passes around the lower wheel 16 and has its other end positively anchored to a suitable yoke 42 secured to the upper pin 22 on which the cam 20 is also mounted.

Figure 4:
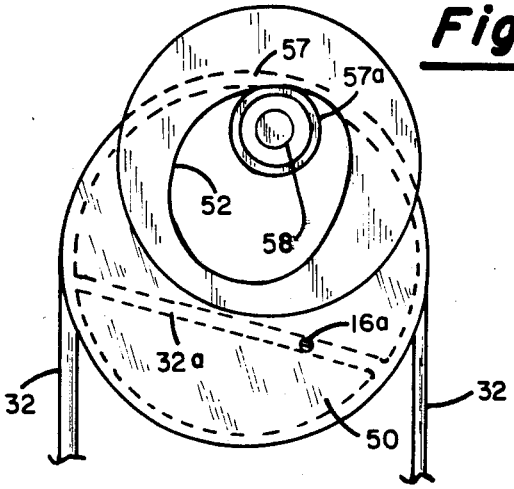
FIG. 4 is a side elevational view of an alternate form of the cam wheel and cam construction, with the wheel and cam in rest position.
Figure 5:
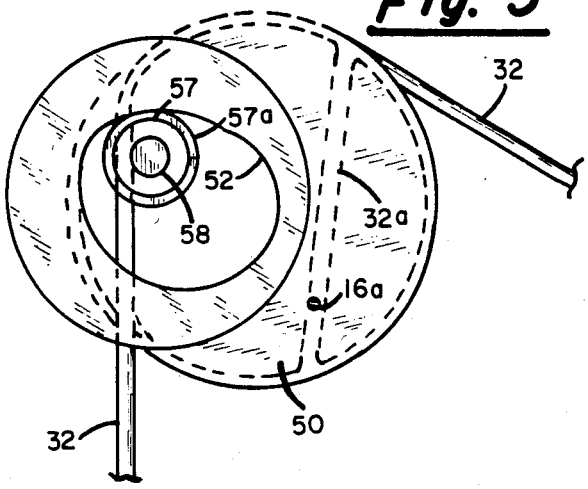
FIG. 5 is a top plan view of the alternative wheel and cam construction shown in FIG. 4, but in full draw position.
Figure 6:
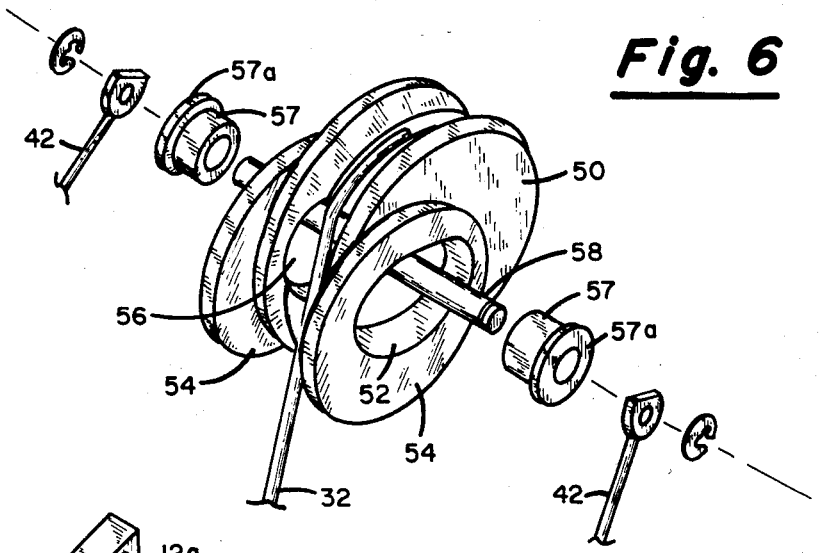
FIG. 6 is an exploded perspective view showing the arrangement of the parts of the alternate wheel and cam construction in approximately the full draw position shown in FIG. 5.
Figure 6:
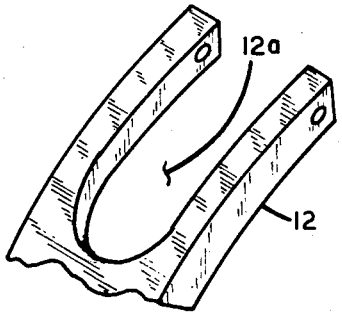

An alternative form of the weight reducing or drop off wheel members 50 is shown in FIGS. 4, 5 and 6. Each of these wheel members has multiple radius eliptical cam slot 52 formed therein with a pair of side boss members 54 fixed to the opposite sides of the main wheel portion 50 as shown. This permits the intermediate portion of the cables 32 and 34 to drop into a recess or cut away portion 56 formed in the circumference of the wheel 50 disposed between the boss members 54. The location of this recess or cut away portion 56 with respect to the circumference of the wheel 50 is approximately the same as the location 18*c* of the cam slot 18 shown in the previously described form of the invention. The form of the invention illustrated in FIGS. 4, 5 and 6 provides a pair of axially aligned cam elements 57 riding within the eliptical cam slot 52 wherein the cam assembly constitutes a pair of split cam elements 57 with flanges 57*a* mounted on a cross mounting pin 58. The pin 58 is connected to the bow in the same manner as previously described in connection with the pin 22.

Figure 2:
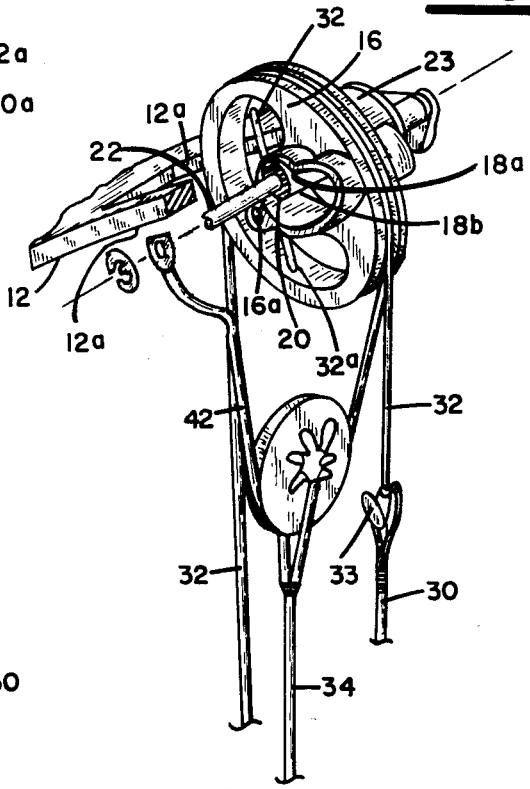
FIG. 2 is a fragmentary perspective view of one of the wheels and cam in rest position.
Figure 3:
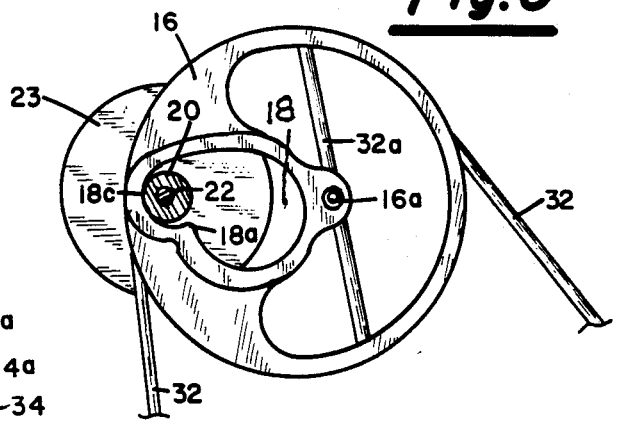
FIG. 3 is a side elevational view of the wheel shown in FIG. 2 with the wheel and cam in their full draw position.

The cut away portion 56 provides a somewhat greater and more rapid weight drop off function than does the form of the wheel and cam slot relation shown in FIGS. 1, 2, and 3.

Figure 7:
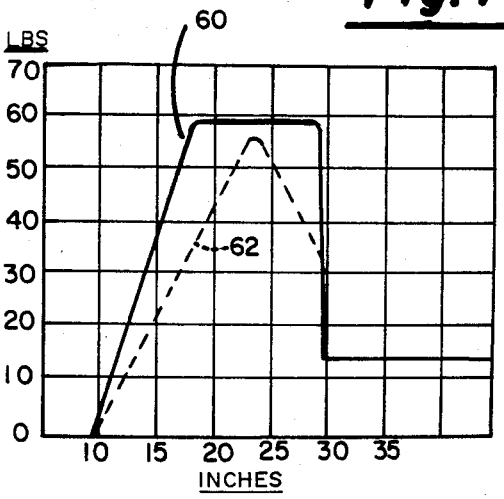
FIG. 7 is a graph showing the drop-off force pattern of the form shown in FIGS. 4, 5 and 6.

It will be apparent from the drawings that the wheels 16 of the first form of the invention and the cables 32 with the bow string 30 attached thereto are rigged on the bow B so that the cam 20 is disposed in substantially spaced relation to the outer periphery of the cam slot 18 as indicated at 18*b* of FIG. 2. As the bow string 30 is drawn back, the wheel 16 rotates and the cam 20 travels around the circumference of the cam slot 18 as indicated by the arrow 19 shown in FIG. 2 to the full draw position 18*c* of the cam slot disposed adjacent to the outer circumference of the wheel. The energy required to draw the bow is equal to the energy stored for propelling the arrow and is represented by the area under the graph line 60 shown in FIG. 7. The dotted graph line 62 shown in FIG. 7 represents a draw weight and drop off for a typical fixed axis eccentric wheel of conventional compound bows. From this graph, two advantages will be apparent. The first is that the holding draw weight after the drop off can be reduced to a far greater extent than is possible with a fixed axis eccentric construction for conventional compound bows. Secondly, the total energy stored with applicant's movable axis construction which is represented by the area under the full graph line 60 of FIG. 7 is substantially greater than the energy storage represented by the area of the dotted graph line 62.

What is claimed is:

1. A compound archery bow assembly having a predetermined progressive draw strength and final full draw drop off, said assembly comprising a bow unit including, a pair of flexible resilient limb elements, a handle connecting the inner ends of said limbs, a pair of pulley wheels rotatably mounted on the outer end portions of the limbs, a bow string, a pair of bow cables having an intermediate portion respectively trained about said pulleys with one end of each cable being anchored to the bow unit and the other end connected to one end of the bow string to produce rotation of the wheels through a predetermined arc, during the operation of the bow, each of said pulley wheels including an interior cam slot having inner and outer portions respectively positioned eccentrically within the wheel, with the outer slot portion disposed substantially adjacent to the circumference of the sheel, and the inner slot portion disposed in radially inwardly spaced relation to the outer slot portion, a cam follower smaller in diameter than the inside dimensions of the slot and mounted on the outer ends of each of the bow limb elements and positioned in said cam slot for traveling movement within the slot from an initial draw position disposed in substantially spaced relation to the outer periphery of the wheel and traversing the cam surface to the full draw position with the cam follower disposed in close association to the outer periphery of the pulley wheel.

2. The structure set forth in claim 1 and said cam slot being eccentrically shaped to produce the desired predetermined progressive draw strength and final draw drop off.

3. The structure set forth in claim 1 and a follower shaft connected to the outer end of each of the bow limb elements and each cam follower being supported by the respective shaft.

4. The structure set forth in claim 1 and said cam follower comprising a pair of cam elements mounted on the shaft and spaced apart axially of the shaft to provide a cable-receiving opening between said cam elements to permit the cable to pass inwardly between said two spaced cam elements when in full draw position.

5. The structure set forth in claim 5 and means for preventing movement of the cam element on the mounting shaft.

6. The structure set forth in claim 1 wherein the cam follower is rotatably mounted on the outer ends of the bow limb elements and positioned in said cam slot for rotatable traveling movement within the slot.

* * * * *